US008061800B2

(12) United States Patent
Wanibe

(10) Patent No.: US 8,061,800 B2
(45) Date of Patent: Nov. 22, 2011

(54) LIQUID DETECTOR AND LIQUID CONTAINER HAVING THE SAME

(75) Inventor: Akihisa Wanibe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 485 days.

(21) Appl. No.: 12/252,415

(22) Filed: Oct. 16, 2008

(65) Prior Publication Data

US 2009/0102870 A1 Apr. 23, 2009

(30) Foreign Application Priority Data

Oct. 16, 2007 (JP) ..... 2007-269354

(51) Int. Cl.
*B41J 29/393* (2006.01)
*B41J 2/195* (2006.01)
*B41J 2/175* (2006.01)

(52) U.S. Cl. ..... 347/19; 347/7; 347/86; 347/87

(58) Field of Classification Search ..... 347/7, 19, 347/86, 87

See application file for complete search history.

(56) References Cited

U.S. PATENT DOCUMENTS

| | | | | |
|---|---|---|---|---|
| 7,225,670 | B2 | 6/2007 | Tsukada et al. | |
| 7,444,864 | B2 | 11/2008 | Yajima et al. | |
| 2005/0130509 | A1 | 6/2005 | Yang | |
| 2007/0085865 | A1 | 4/2007 | Tsukada et al. | |
| 2008/0238956 | A1 * | 10/2008 | Wanibe et al. | 347/7 |
| 2009/0009561 | A1 | 1/2009 | Yajima et al. | |

FOREIGN PATENT DOCUMENTS

| | | | |
|---|---|---|---|
| CN | 2682629 | Y | 3/2005 |
| CN | 1305682 | C | 3/2007 |
| JP | 05-052866 | A | 3/1993 |
| JP | 2001-057204 | A | 2/2001 |
| JP | 2001-146030 | A | 5/2001 |
| JP | 2003-346931 | A | 12/2003 |
| JP | 2006-281550 | A | 10/2006 |
| JP | 2007-015408 | A | 1/2007 |

* cited by examiner

*Primary Examiner* — Julian Huffman
(74) *Attorney, Agent, or Firm* — Sughrue Mion, PLLC

(57) ABSTRACT

A liquid detector includes: a case in which a flow channel is exposed from an opening; a sensor base, disposed in the opening of the case to face the flow channel; a sensor chip, mounted on a surface opposite to a surface of the sensor base which faces the flow channel and including a piezoelectric element; a film, adapted to hold the sensor base in the opening and sealing the opening; a circuit board, disposed in such a manner as to face the sensor chip; a relay terminal, electrically connecting the sensor chip and the circuit board; and a support member, adapted to support the circuit board and the relay terminal and fixed to the case. The relay terminal includes: a base end portion, fixed to the support member; and first and second free end portions, separately extending into two branches from the base end portion, and a first contact connected to the circuit board is formed in the first free end portion, and a second contact connected to the sensor chip is formed in the second free end portion.

12 Claims, 13 Drawing Sheets

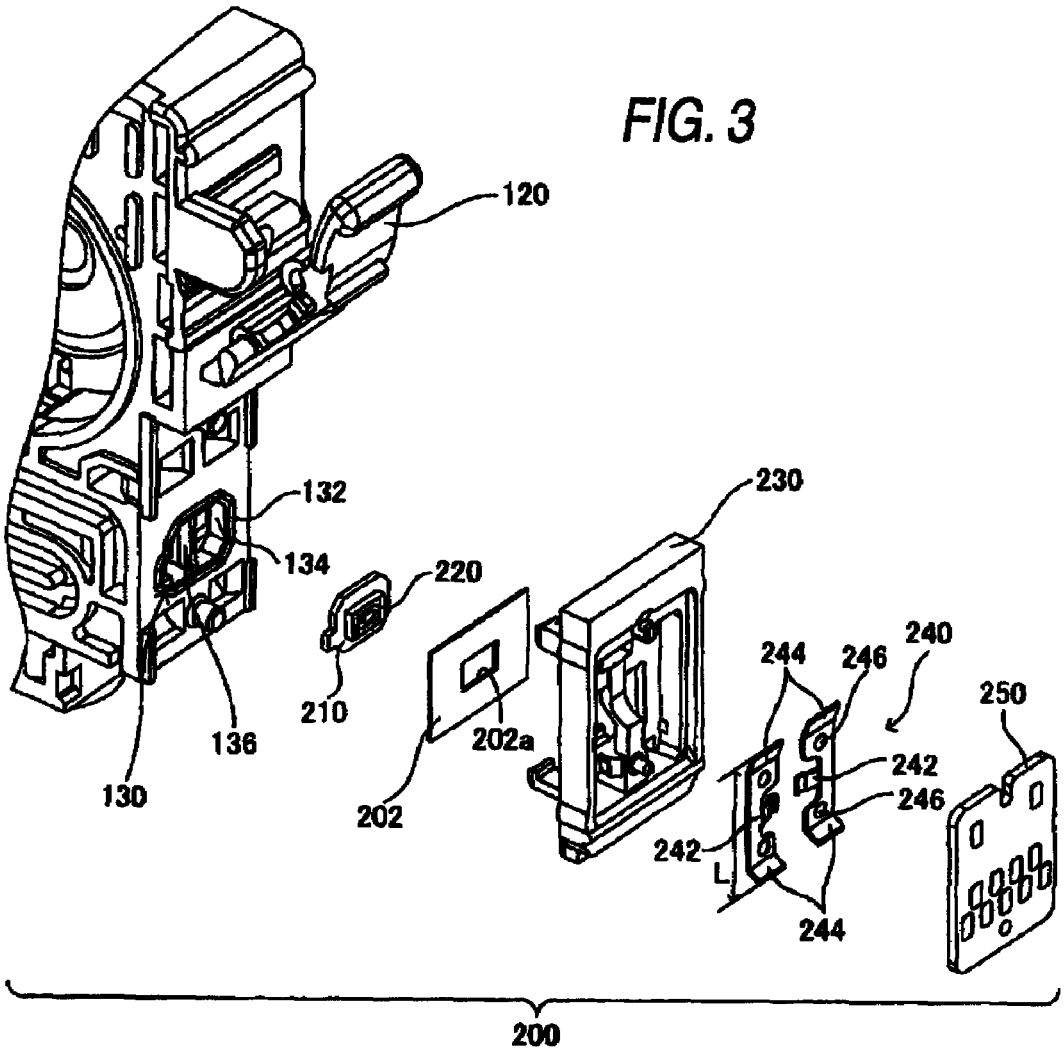
FIG. 3
FIG. 4A
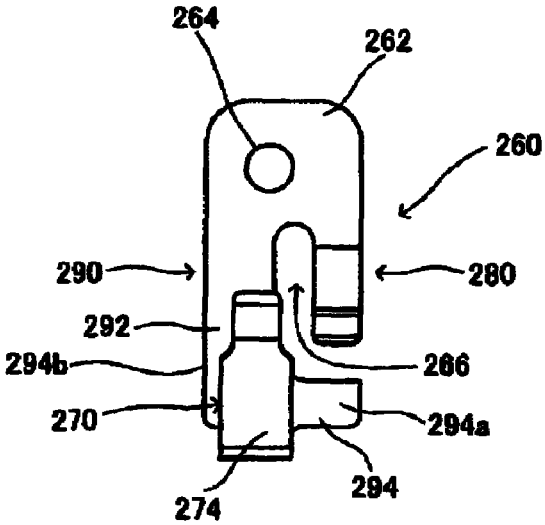
FIG. 4B
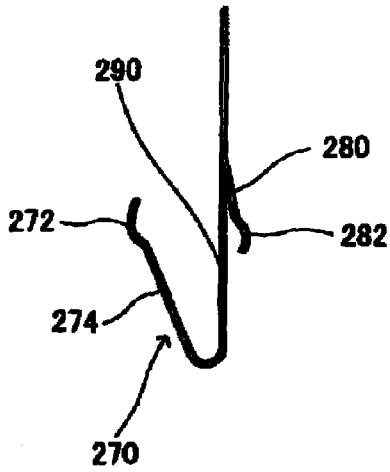

LIQUID DETECTOR AND LIQUID CONTAINER HAVING THE SAME

BACKGROUND

1. Technical Field

The present invention relates to a liquid detector that can suitably detect an amount of remaining liquid (ink) in a liquid consuming apparatus such as an inkjet printing apparatus and a liquid container having the liquid detector.

2. Related Art

As a representative example of a liquid consuming apparatus, there is an inkjet printing apparatus having an inkjet print head for printing an image. Other liquid ejecting apparatuses may include an apparatus having a coloring material ejecting head used for manufacturing a color filter and the like of a liquid display, an apparatus having an electrode material (conductive paste) ejecting head used for forming electrodes of an organic EL display, a field emission display (FED), and the like, an apparatus having a biological organic material ejecting head used for manufacturing a bio chip, and an apparatus having a sample ejecting head as a precise pipette.

In the inkjet printing apparatus as the representative example of the liquid consuming apparatus, an inkjet print head having a pressure generator pressurizing a pressure generating chamber and nozzle orifices ejecting the pressurized ink as ink droplets is mounted on a carriage. By endlessly supplying the ink in an ink container to the print head through a flow channel, a printing operation can be continuously performed. The ink container is constructed as a detachable cartridge that can be replaced by a user when the ink is completely consumed.

There is a method of managing ink consumption by integrating the number of ink droplets emitted from the print head or the amount of ink sucked in maintenance by software or a method of managing when the ink is actually consumed by a predetermined amount by attaching a liquid level detecting electrode to the ink cartridge, as a method of managing the ink consumption of an ink cartridge.

However, the method of managing the ink consumption by integrating the number of ejected ink droplets or the amount of ink by software causes the following problem. The head may eject ink droplets with non-uniformity in weight. The non-uniformity in weight of the ink droplets does not affect the image quality but the ink with a margin is filled in the ink cartridge in consideration of accumulation of errors in ink consumption due to the non-uniformity. Accordingly, there is a problem that the ink corresponding to the margin remains in some apparatuses.

On the other hand, in the method of managing when the ink is consumed by the use of an electrode, since the actual amount of remaining ink can be detected, it is possible to manage the amount of remaining ink with high reliability. However, since the detection of the ink level depends on the conductivity of the ink, the kinds of ink detectable are limited, thereby complicating the sealing structure of the electrode. Since precious metals with excellent conductivity and anti-corrosion are usually used as the material of the electrode, the cost for manufacturing the ink cartridge is enhanced. Since two electrodes should be necessarily formed, the number of manufacturing processes increases, thereby increasing the manufacturing cost.

Therefore, to solve the above-mentioned problems, a piezoelectric device (herein, referred to as a sensor unit) is disclosed in JP-A-2001-146030. The sensor unit monitors the amount of ink remaining in the ink cartridge by the use of the resonance frequency of a residual vibration signal resulting from the residual vibration (free vibration) of a vibrating plate after forcible vibration when the ink remains and does not remain in a sensor cavity opposed to the vibrating plate having a piezoelectric element formed thereon.

In JP-A-2006-281550, a metal sensor base mounted with a sensor chip including a piezoelectric element is sealed in a concave portion of the unit base by a film, and is then arranged and assembled. The sensor base of the unit base is disposed to face an ink outflow channel of an ink container. Here, the unit base is disposed liquid-tight with respect to the ink container by the use of sealing rubber. In order to guarantee the liquid-tight property of the sealing rubber, a spring pressing the unit base against the ink container is provided.

The sensor chip is electrically connected to a circuit board held in the unit base. Here, the relay terminal electrically connecting the sensor chip to the circuit board needs to have a shape that is reliably fixed to the unit base and that guarantees the electrical connection in a small defined space. Known terminal structures are disclosed in JP-A-2001-57204, JP-A-5-52866, and JP-A-2003-346931.

The technique disclosed in JP-A-2006-281550 can embody the detection principle disclosed in JP-A-2001-146030, but requires the unit base independently of the ink container. Accordingly, the sealing rubber and the spring are essential to liquid-tightly fix the unit base to the ink container.

Accordingly, in JP-A-2006-281550, the number of components increases and the assembly for guaranteeing the liquid-tight property of the sealing rubber is complicated.

The unit base is shaped by two colors of polypropylene and elastomer and thus the cost therefor is high.

In the terminal structures disclosed in JP-A-2001-57204, JP-A-5-52866, and JP-A-2003-346931, specific contacts as a target of the respective structures are connected, which is not suitable for the connection between the sensor chip and the circuit board parallel thereto as a target of the invention. Particularly, when the arrangement space of the relay terminal connecting the sensor chip to the circuit board is narrowed, a fixing portion for fixing the relay terminal by thermal welding and the like is guaranteed at only one position, and thus the requirement for satisfactorily guaranteeing the contact pressures on the sensor chip and the circuit board needs to be satisfied.

SUMMARY

An advantage of some aspects of the invention is that it provides a liquid detector that can satisfactorily guarantee contact pressures on the sensor chip and the circuit board under the constraint that the arrangement space of the relay terminal connecting the sensor chip and the circuit board to each other and a liquid container employing the liquid detector.

Another advantage of some aspects of the invention is that it provides a liquid detector that can accurately position the relay terminal regardless of action and reaction when the contact pressures on the sensor chip and the circuit board is reliably guaranteed, under the constraint that the fixing portion for fixing the relay terminal by thermal welding should be guaranteed at only one position, and a liquid container employing the liquid detector.

Another advantage of some aspects of the invention is that it provides a liquid detector having a structure that can increase the amplitude at the time of detecting a liquid while guaranteeing the above-mentioned structure of the relay terminal and a liquid container employing the liquid detector.

According to an aspect of the invention, there is provided A liquid detector including: a case in which a flow channel is exposed from an opening; a sensor base, disposed in the opening of the case to face the flow channel; a sensor chip, mounted on a surface opposite to a surface of the sensor base which faces the flow channel and including a piezoelectric element; a film, adapted to hold the sensor base in the opening and sealing the opening; a circuit board, disposed in such a manner as to face the sensor chip; a relay terminal, electrically connecting the sensor chip and the circuit board; and a support member, adapted to support the circuit board and the relay terminal and fixed to the case. The relay terminal includes: a base end portion, fixed to the support member; and first and second free end portions, separately extending into two branches from the base end portion, and a first contact connected to the circuit board is formed in the first free end portion, and a second contact connected to the sensor chip is formed in the second free end portion.

The present disclosure relates to the subject matter contained in Japanese patent application No. 2007-269354 filed on Oct. 16, 2007 which is expressly incorporated herein by reference in its entirety.

BRIEF DESCRIPTION OF THE DRAWINGS

The invention will be described with reference to the accompanying drawings, wherein like numbers reference like elements.

FIG. 3 is an exploded perspective view of an ink detector where a part of FIG. 2 is enlarged.

FIGS. 4A and 4B are a plan view and a right side view of an improved relay terminal, respectively.

DESCRIPTION OF EXEMPLARY EMBODIMENTS

Hereinafter, exemplary embodiments of the invention will be described in detail. The following embodiments do not excessively limit the scope of the invention described in the appended claims and all elements described in the embodiments are not essential to the solving means of the invention.

Ink Cartridge

An ink cartridge (liquid container) to which a liquid detecting device according to an embodiment of the invention is attached will be described now with reference to the accompanying drawings.

Figure 1:
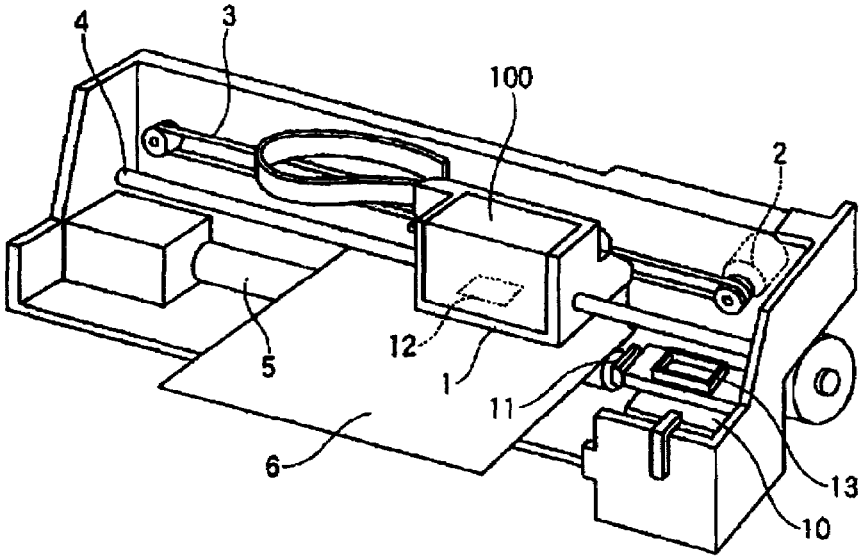
FIG. 1 is a schematic perspective view of an inkjet printer as a liquid consuming apparatus.

FIG. 1 is a diagram schematically illustrating a configuration of an inkjet printing apparatus (liquid consuming apparatus) employing the ink cartridge according to this embodiment. A carriage 1 is guided by a guide member 4 through a timing belt 3 driven by a carriage motor 2 to reciprocate in the axis direction of a platen 5.

An inkjet print head 12 is mounted on a side of the carriage 1 facing a printing sheet 6. An ink cartridge 100 supplying ink (water ink or oil ink) to the print head 12 is demountably mounted on a holder (not shown) disposed in the upper portion of the carriage 1.

A cap member 13 is disposed at a home position (in the right side in FIG. 1) which is a non-printing area of the printing apparatus. The cap member 13 is pressed on a nozzle formation surface of the print head 12 to form a closed space with the nozzle formation surface, when the print head 12 mounted on the carriage 1 moves to the home position. A pump unit 10 giving a negative pressure to the closed space formed by the cap member 13 to perform a cleaning process is disposed below the cap member 13.

In the vicinity of a printing area in the cap member 13, a wiping unit 11 having an elastic plate of rubber is disposed to reciprocate in the horizontal direction about the moving trace of the print head 12. The wiping unit 11 wipes out the nozzle formation surface of the print head 12 as needed when the carriage 1 reciprocates with respect to the cap member 13.

Figure 2:
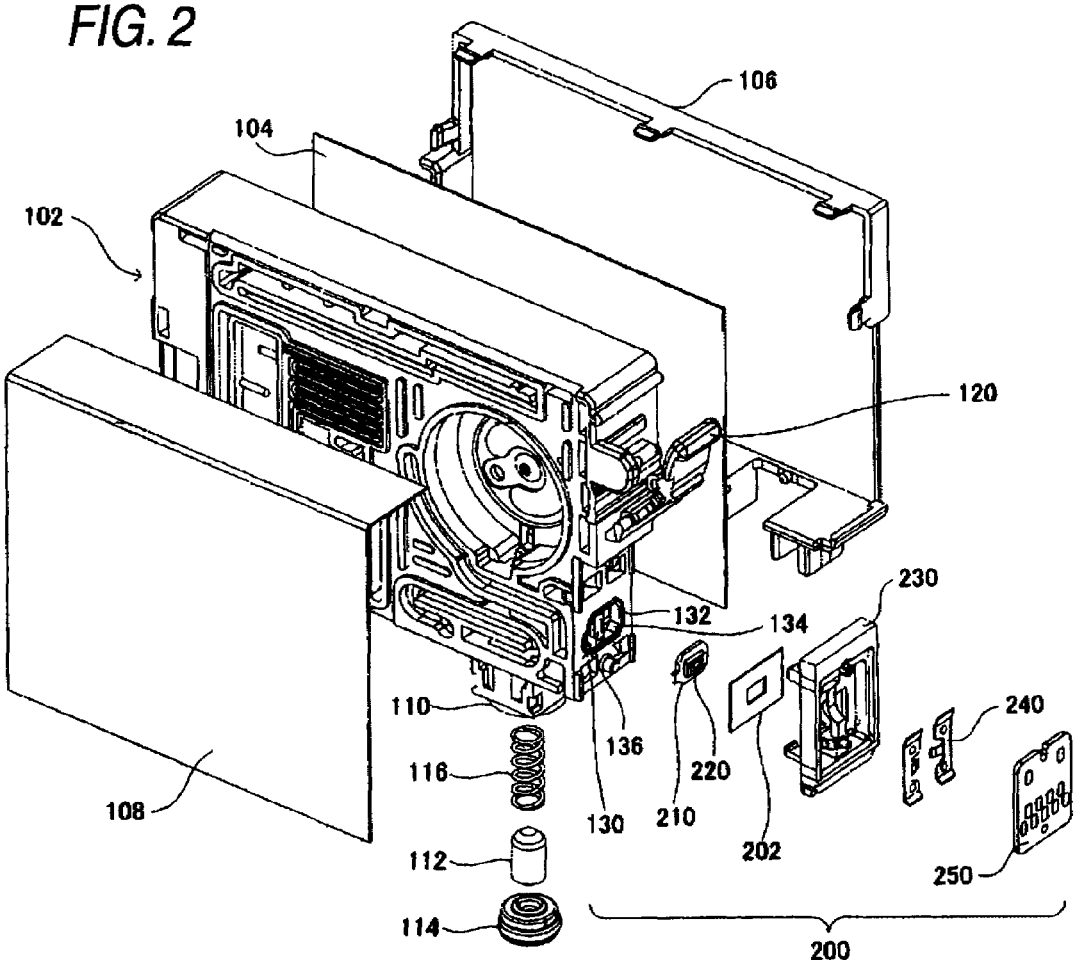
FIG. 2 is an exploded perspective view of an ink cartridge mounted and demounted on and from a carriage of the inkjet printer, where a relay terminal of a comparative example is shown.

FIG. 2 is a perspective view schematically illustrating a configuration of an ink cartridge 100. In FIG. 1, the ink cartridge 100 is disposed to correspond to the vertical direction in the state where the ink cartridge is mounted on the carriage 1. Accordingly, the term "vertical" used in the following description means the vertical direction in the state where the ink cartridge 100 is mounted on the carriage 1.

The ink cartridge 100 includes a film 104 covering the rear surface of the main case 102, a cover member 106 covering the film 104 and the bottom surface of the main case 102, and a film 108 covering the surface and the top surface of the main case 102.

The main case 102 is partitioned by ribs or walls. The main case 102 includes an ink channel section having an ink containing area and an ink delivery channel, an ink-side passage allowing the ink containing area to communicate with the atmospheric air, and an atmospheric communication portion having an atmospheric air valve receiving chamber and an atmospheric air-side passage, detailed description of which are omitted (for example, see JP-A-2007-15408).

The ink delivery channel of the ink channel section finally communicates with an ink supply section 110 and the ink in the ink cartridge 100 is sucked up from the ink supply section 110 for supply by the negative pressure.

An ink supply needle (not shown) of the holder disposed in the carriage 1 is inserted into the ink supply section 110. The ink supply section 110 includes a supply valve 112 that is pressed by the ink supply needle and slides to open its valve, a sealing member 114 formed of an elastic material such as elastomer, which is fitted to the surrounding of the ink supply needle, and an urging member 116 formed of a coil spring to urge the sealing member 114 to the supply valve 112. Theses elements are assembled by fitting the urging member 116, inserting the sealing member 114 to the ink supply section 110, and finally pushing the supply valve 112.

A lever 120 engaging with the holder disposed in the carriage 1 is disposed on one side surface of the main case 102. An opening 130 opened at a position corresponding to the upstream from the ink supply section 110 and the end of the ink delivery channel is formed at a position on one side surface of the main case 102, for example, at a position below the lever 120. A welding rib 132 is formed in the circumferential edge of the opening 130. A partition rib 136 partitions the ink delivery channel 134 facing the opening 130 into an upstream buffer chamber 134*a* and a downstream buffer chamber 134*b* (the reference numerals are omitted in FIG. 2; see FIGS. 6 and 7) is formed.

Ink Detector

An ink detector 200 employing the liquid detector according to this embodiment, which is formed by the main case 102, the ink delivery channel 134, and the partition rib 136, will be described now with reference to FIGS. 2 and 3. FIG. 3 is an enlarged view of the ink detector 200 in the ink cartridge 100 shown in FIG. 2. However, a relay terminal 240 as a comparative example is shown in FIGS. 2 and 3.

In FIGS. 2 and 3, the ink detector 200 includes a resin main case 102 in which the ink delivery channel 134 is formed, a metal sensor base 210 disposed in the opening 130 of the main case 102 to face the ink delivery channel 134, a sensor chip 220 mounted on a surface of the sensor base 210 opposite to the surface facing the ink delivery channel 134, a film 202 holding the sensor base 210 in the opening 130 and sealing the opening 130, and a partition wall 136 partitioning the ink delivery channel 134 in the main case 102 into upstream and downstream. The film 202 is bonded to the top surface of the sensor base 210 and is welded to the welding rib 132 around the opening 130.

In FIGS. 2 and 3, the ink detector 200 includes a pressing cover 230 disposed above the sensor base 210, the sensor chip 220, and the film 202, a relay terminal 240 as a comparative example having contacts 242 received in the pressing cover 230 and coming in electrical contact with the sensor chip 220 through a hole 202*a* formed in the film 202, and a circuit board 250 received in the pressing cover 230 and electrically connected to the contacts 244 of the relay terminal 240. As described later, the pressing cover 230 can be combined with the main case 102.

Relay Terminal and Pressing Cover

The function of the relay terminal 240 shown in FIGS. 2 and 3 causes no problem, but there is a need for reducing the length L shown in FIG. 3 with the requirement for decrease in size. The relay terminal 240 shown in FIG. 3 includes two holes 246. The relay terminal 240 is fixed to the pressing cover 230 by inserting and then thermally welding bosses (not shown) of the pressing cover 230 into and to the holes 246. In the relay terminal 240 fixed to the pressing cover 230 through two holes (thermal welding and fixing portions) 246, the reaction does not affect the contacts 242 and 244 due to the thermal welding and fixing portions 246 interposed between two contacts 242 and 244 even when the contact pressures of the contacts 242 and 244 are properly adjusted. Here, as described above, when it is intended to reduce the length L, the thermal welding portions cannot be disposed at two positions.

Figure 5:
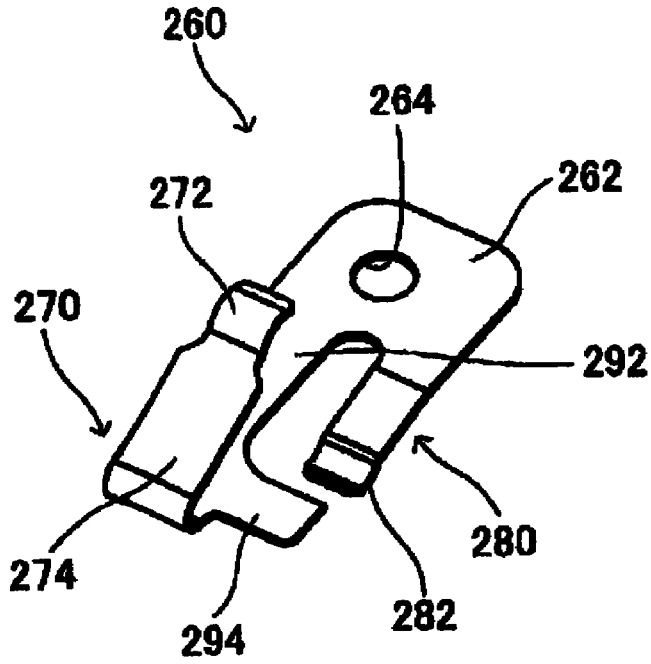
FIG. 5 is a perspective view of the relay terminal.
Figure 6:
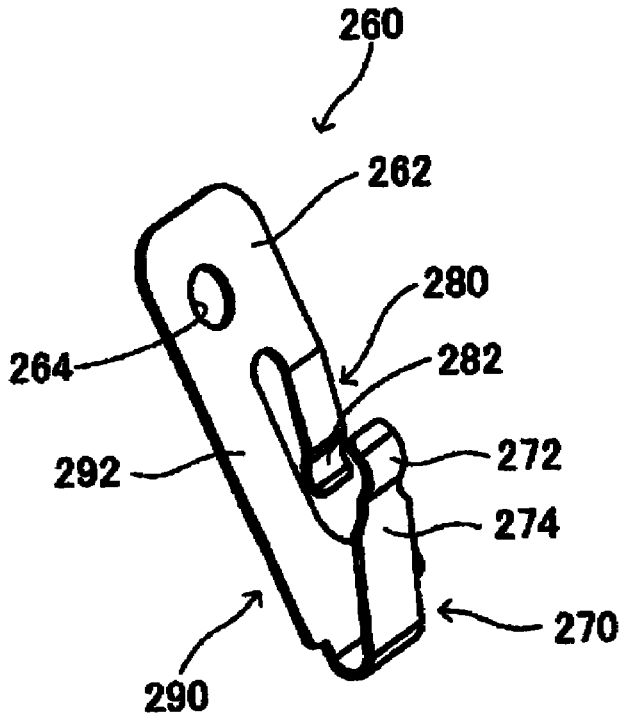
FIG. 6 is a perspective view of the relay terminal as viewed at an angle different from that of FIG. 5.
Figure 7B:
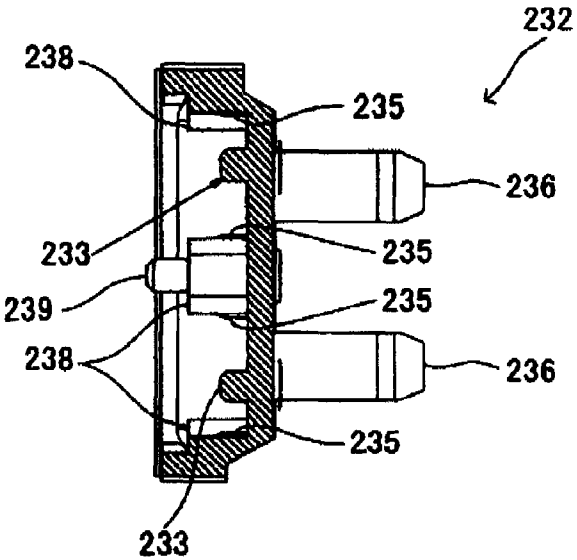
FIG. 7B is a longitudinal sectional view of the pressing cover.
Figure 7A:
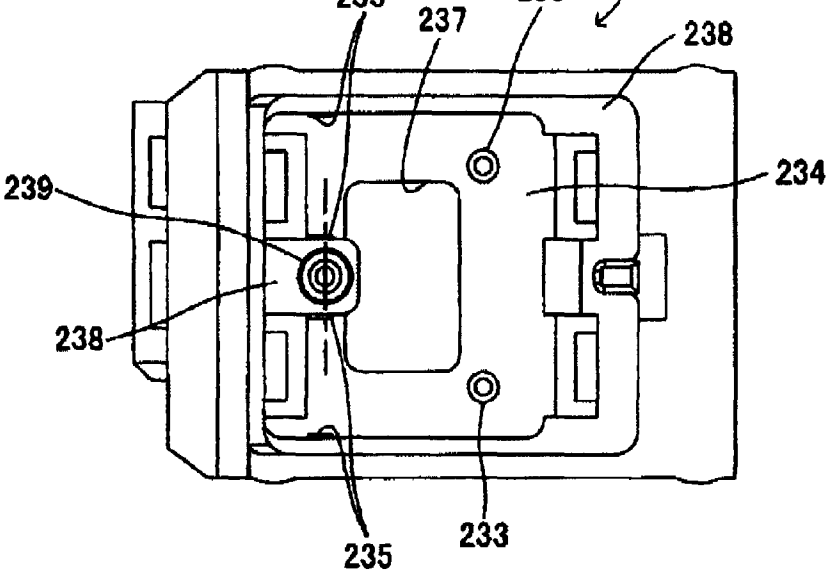
FIG. 7A is a plan view of an improved pressing cover.
Figure 7C:
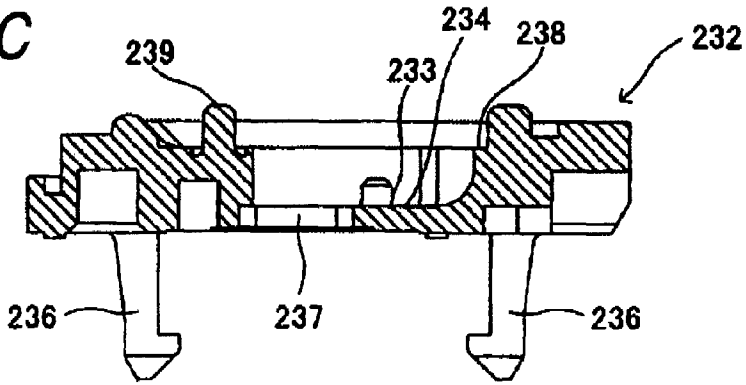
FIG. 7C is a lateral sectional view of the pressing cover.
Figure 8:
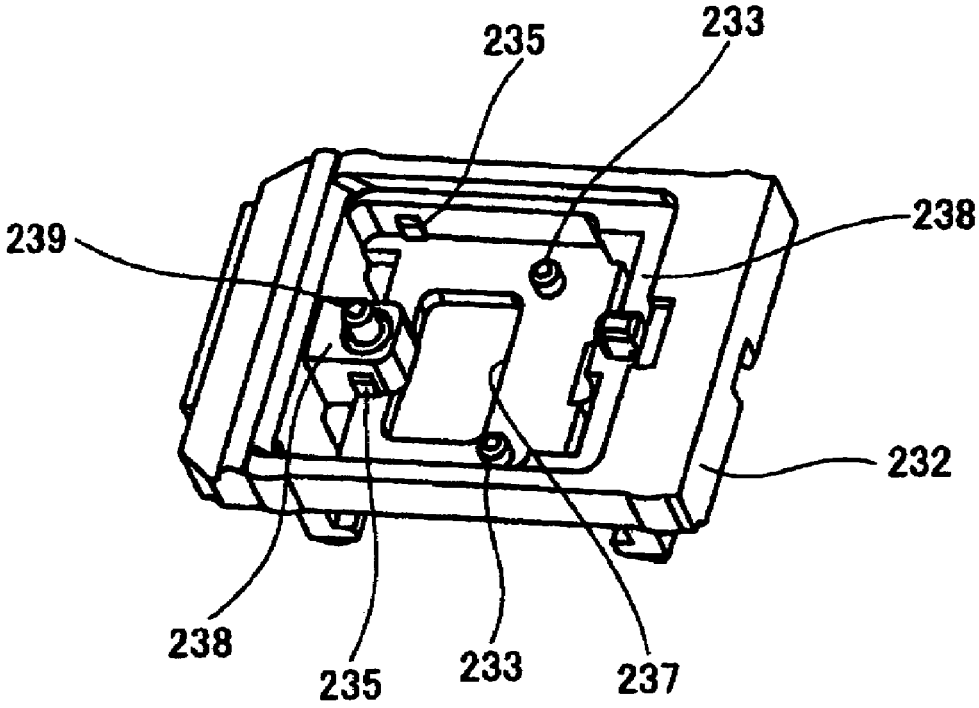
FIG. 8 is a perspective view of the pressing cover.
Figure 9:
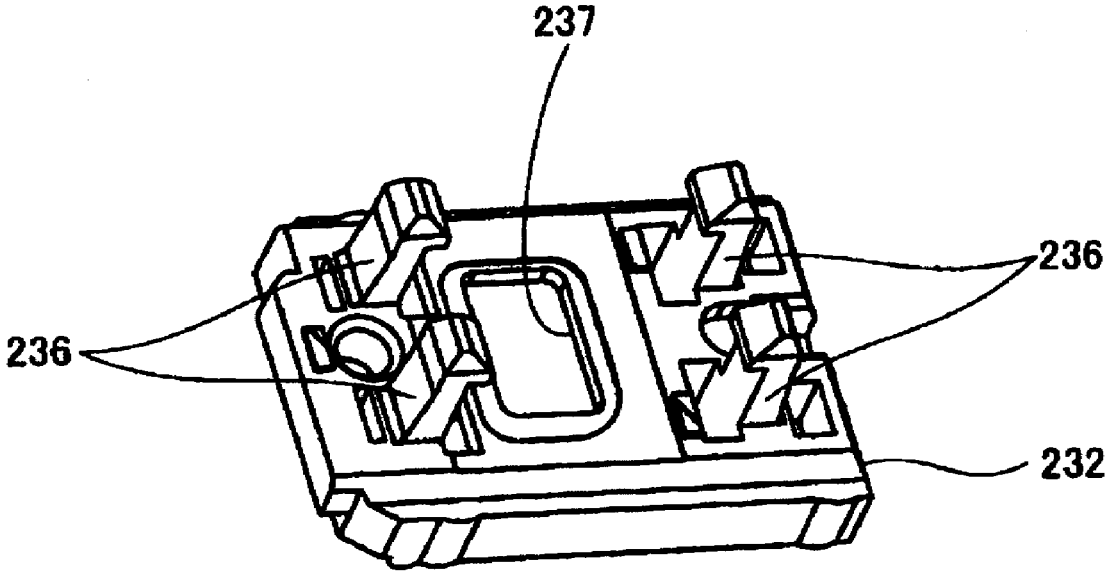
FIG. 9 is a perspective view of the pressing cover as viewed at an angle different from that of FIG. 8.

Therefore, in this embodiment, the pressing cover 230 and the relay terminal 240 shown in FIG. 3 are improved. FIGS. 4A and 4B are a plan view and a right side view of the improved relay terminal 260, respectively. FIGS. 5 and 6 are perspective views of the relay terminal 260 as viewed at different angles. FIG. 7A is a plan view of the improved pressing cover 232, FIG. 7B is a longitudinal sectional view of the pressing cover 232, and FIG. 7C is a cross sectional view of the pressing cover 232. FIGS. 8 and 9 are perspective views of the pressing cover 232 as viewed at different angles.

The relay terminal 260 shown in FIGS. 4A to 6 a base end portion 262 fixed to the main case 102 or the pressing cover 232 shown in FIGS. 7A to 9 and first and second free end portions 270 and 280 extending in two branches from the base end portion 262. That is, a slit 266 is formed between the first and second free end portions 270 and 280 extending in parallel from the base end portion 262. The first contact 272 connected to the circuit board 250 is formed at the end of the first free end portion 270 and the second contact 282 connected to the sensor chip 220 is formed at the end of the second free end portion 280. A hole 264 into and to which the boss 233 (see FIGS. 7A to 8) formed in the main case 102 or the pressing cover 232 is inserted and thermally welded is formed in the base end portion 262.

Accordingly, in the relay terminal 260 shown in FIGS. 4A to 6, since the first and second free end portions 270 and 280 extend from the base end portion 262 in the same direction and the slit 266 is interposed between both free end portions, the thermal welding and fixing portion 264 is interposed between two contacts 272 and 282. Therefore, even when the first contact 272 formed at the first free end portion 270 has elasticity to adjust the contact pressure acting on the circuit board 260, the reaction force thereof is absorbed by the base end portion 262 and thus does not affect the second free end portion 280. On the contrary, even when the second contact 282 formed at the second free end portion 280 has elasticity to adjust the contact pressure acting on the sensor chip 220, the reaction force thereof is absorbed by the base end portion 262 and thus does not affect the first free end portion 270. Under the constraint that the arrangement space of the relay terminal 260 connecting the sensor chip 220 and the circuit board 250, the contact pressures on the sensor chip 220 and the circuit board 250 can be satisfactorily guaranteed. Particularly, under the constrain that the fixing portion 264 fixing the relay terminal 260 by thermal welding can be guaranteed at only one position in the base end portion 262, the contact pressures on the sensor chip 220 and the circuit board 250 can be satisfactorily guaranteed.

In the relay terminal 260 shown in FIGS. 4A to 6, the first contact 272 and the second contact 282 are bent in the opposite directions with respect to the two-dimensional plane 234 (see FIGS. 7A to 8) of the pressing cover 232 or the main case 102 coming in contact with the base end portion 262. In this way, by bending the first and second contacts 272 and 282 in the opposite directions, the first and second contacts 272 and 282 can come in contact with the circuit board 250 and the sensor chip 220 having an opposed distance therebetween while guaranteeing predetermined contact pressures thereon.

In the relay terminal 260 shown in FIGS. 4A to 6, the length from the base end portion 262 to the first contact 272 of the first free end portion 270 is greater than the length from the base end portion 262 to the second contact 282 of the second free end portion 280.

Accordingly, the relay terminal 260 has an intermediate portion 290 between the base end portion 262 and the first free end portion 270. The first free end portion 270 has a folded portion 274 folded in the U or V shape at the boundary between the intermediate portion 290 and the first free end portion 270. The first contact 272 is formed in the folded portion 274. The first free end portion 270 is not necessarily folded, but has an advantage that the first contact 272 can be easily positioned at the electrode position of the circuit board 250 due to the folding.

The formation of the intermediate portion 290 causes the positioning portion positioned in the main case 102 or the pressing cover 232 to be easily disposed. That is, the relay terminal 260 is fixed to the boss 233 (see FIGS. 7A to 8) of the main case 102 or the pressing cover 232 at one position (hole 264) of the base end portion 262, but it is preferable that it is positioned at the other end and is regulated in the rotation direction about the base end portion 262. In the relay terminal 260 according to this embodiment shown in FIGS. 4A to 6, the positioning portions 235 (see FIGS. 7A to 8) coming in contact with both sides in the width direction of the intermediate portion 290 of the first free end portion 270 longer than the second free end portion 280 can be disposed in the main case 102 or the pressing cover 232.

In this embodiment, the intermediate portion 290 includes a small-width portion 292 extending in parallel to the second free end portion 280 and a large-width portion 294 disposed between the small-width portion 292 and the first free end portion 270 and protruding to the second free end portion 280. In this case, the positioning portions can be disposed to come in contact with both ends 294*a* and 294*b* in the width direction of the large-width portion 294. Since the positioning portion 294 can be formed with a large width, the strength of the positioning portion 294 can be guaranteed.

In this case, the intermediate portion 290 is not curved and is flush with the base end portion 262. Accordingly, in the main case 102 or the pressing cover 232 fixing the base end portion 262, the protrusion 235 protruding from the two-dimensional plane 234 flush with the fixing surface of the base end portion 262 can be formed as the positioning portion.

The first free end portion 270 need not have the folded portion 274 necessarily. The first free end portion 270 may be bent obliquely upward and the second free end portion 280 may be bent obliquely downward as shown in FIG. 5. In this case, the elasticity of the first and second contacts 272 and 282 can be guaranteed by the elasticity of the first and second free end portions 270 and 280 extending in two branches from the base end portion 262 with respect to the base end portion 262.

When the pressing cover 232 is used, the pressing cover 232 includes plural leg portions 236 protruding from the rear surface as shown in FIGS. 7B, 7C, and 9, and the plural leg portions 236 is locked and held by the main case 102. The pressing cover 232 has a cut portion 237 penetrating the front and rear surfaces as shown in FIGS. 7A to 9. The second free end portion 280 of the relay terminal 260 is guided to the position coming contact with the sensor chip 220 through the cut portion 237. The pressing cover 232 includes a mounting surface 238 for the circuit board 250 (see FIGS. 7A to 8) and the circuit board 250 is mounted on the mounting surface 238. The circuit board 250 mounted on the mounting surface 238 is fixed to the mounting surface 238 by thermally welding the boss 239 protruding from the mounting surface 238.

Figure 10:
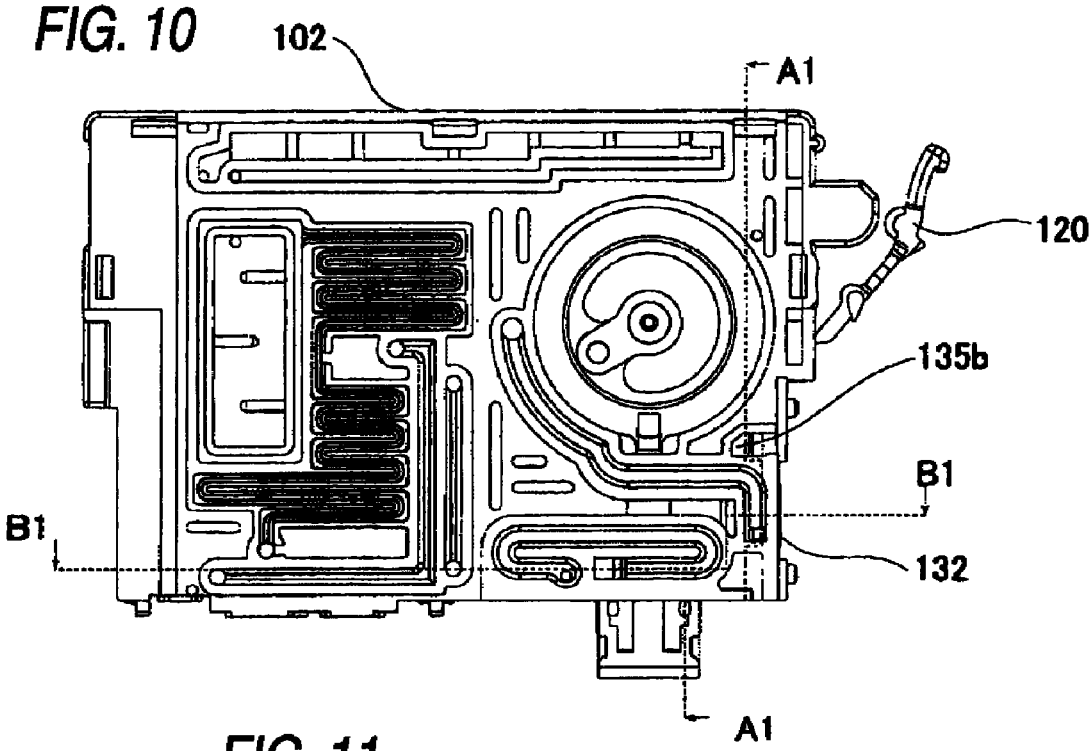
FIG. 10 is a front view of an ink cartridge.
Figure 11:
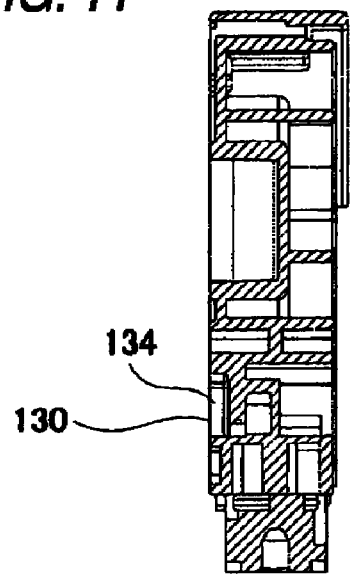
FIG. 11 is a sectional view taken along line A1-A1 of FIG. 10.

Details of the ink detector 200 will be described now with reference to FIGS. 10 to 19. FIG. 10 is a front view of the main case 102. As shown in FIG. 11 which is a sectional view taken along line XIA1-XIA1 of FIG. 10, the ink delivery channel 134 is exposed from the opening 130 at the position close to the end before reaching the ink supply section 110 shown in FIG. 1.

Figure 12:
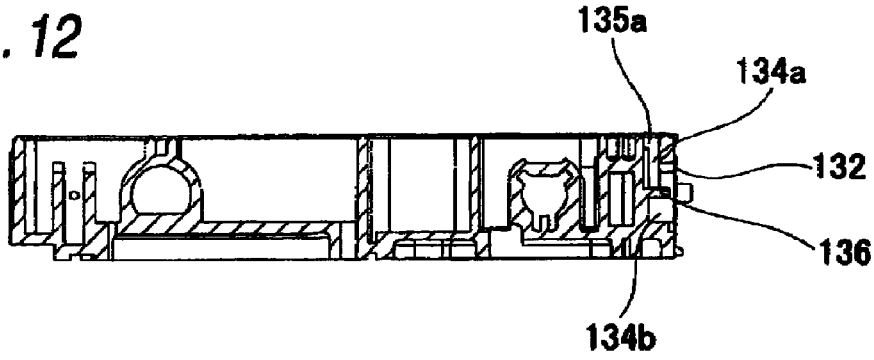
FIG. 12 is a sectional view taken along line B1-B1 of FIG. 10.
Figure 13:
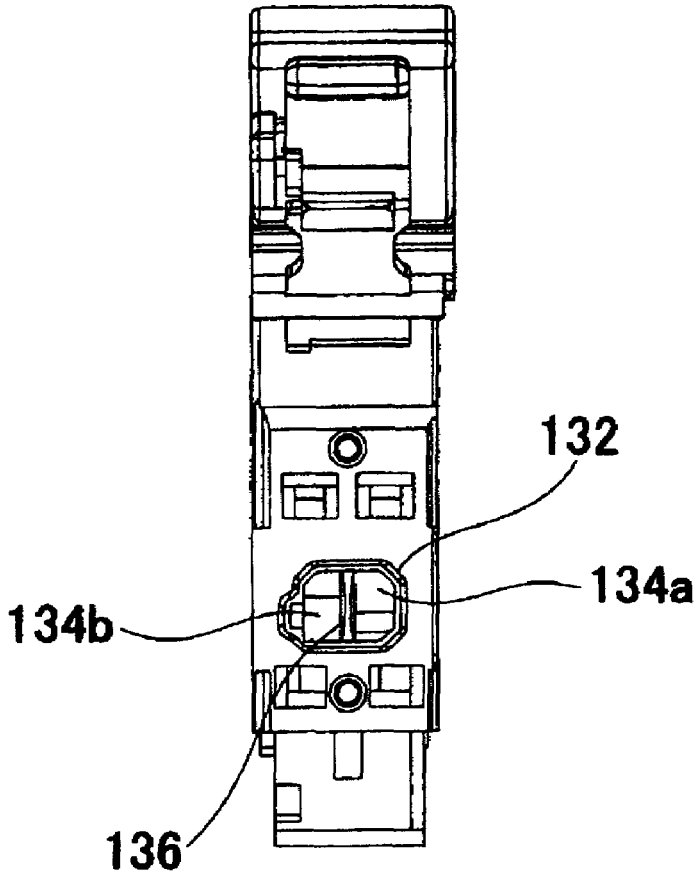
FIG. 13 is a right side view of the ink cartridge.

As shown in FIG. 12 which is a sectional view taken along line B1-B1 of FIG. 10 and FIG. 13 which is a right side view of the ink cartridge 100, the ink delivery channel 134 exposed from the opening 130 is partitioned into the upstream buffer chamber 134*a* and the downstream buffer chamber 134*b* by the partition wall 136. The inlet 135*a* is disposed to face the upstream buffer chamber 134*a* as shown in FIG. 12 and the outlet 135*b* is disposed to face the downstream buffer chamber 134*b* as shown in FIG. 10.

Figure 14:
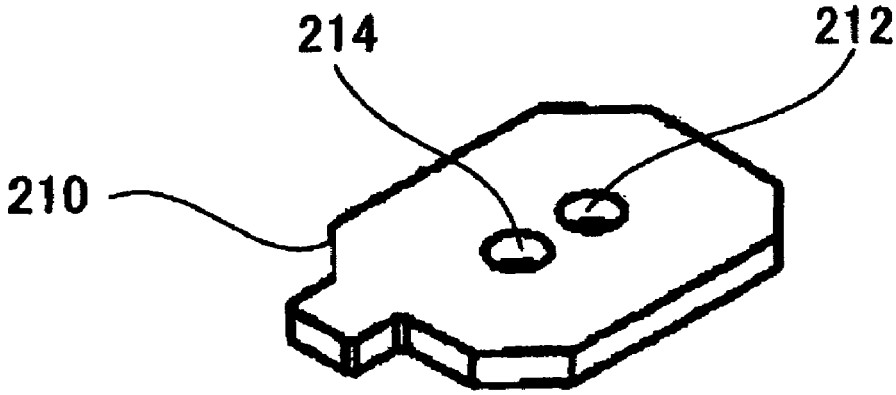
FIG. 14 is a perspective view of a sensor base as viewed from the rear side.
Figure 15:
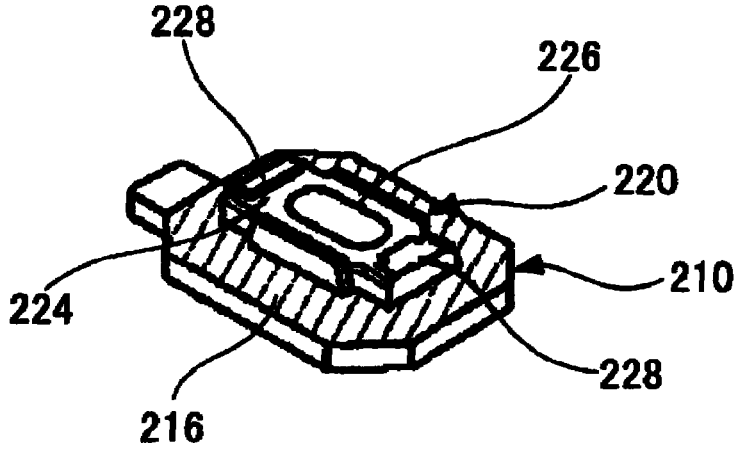
FIG. 15 is a perspective view of the sensor base with a sensor chip mounted thereon as viewed from the outside.

FIG. 14 is a perspective view of the sensor base 210 as viewed from the downside. As shown in FIG. 15, a first hole (supply path) 212 and a second hole (discharge path) 214 penetrating the sensor base 210 in the thickness direction are disposed.

Figure 16:
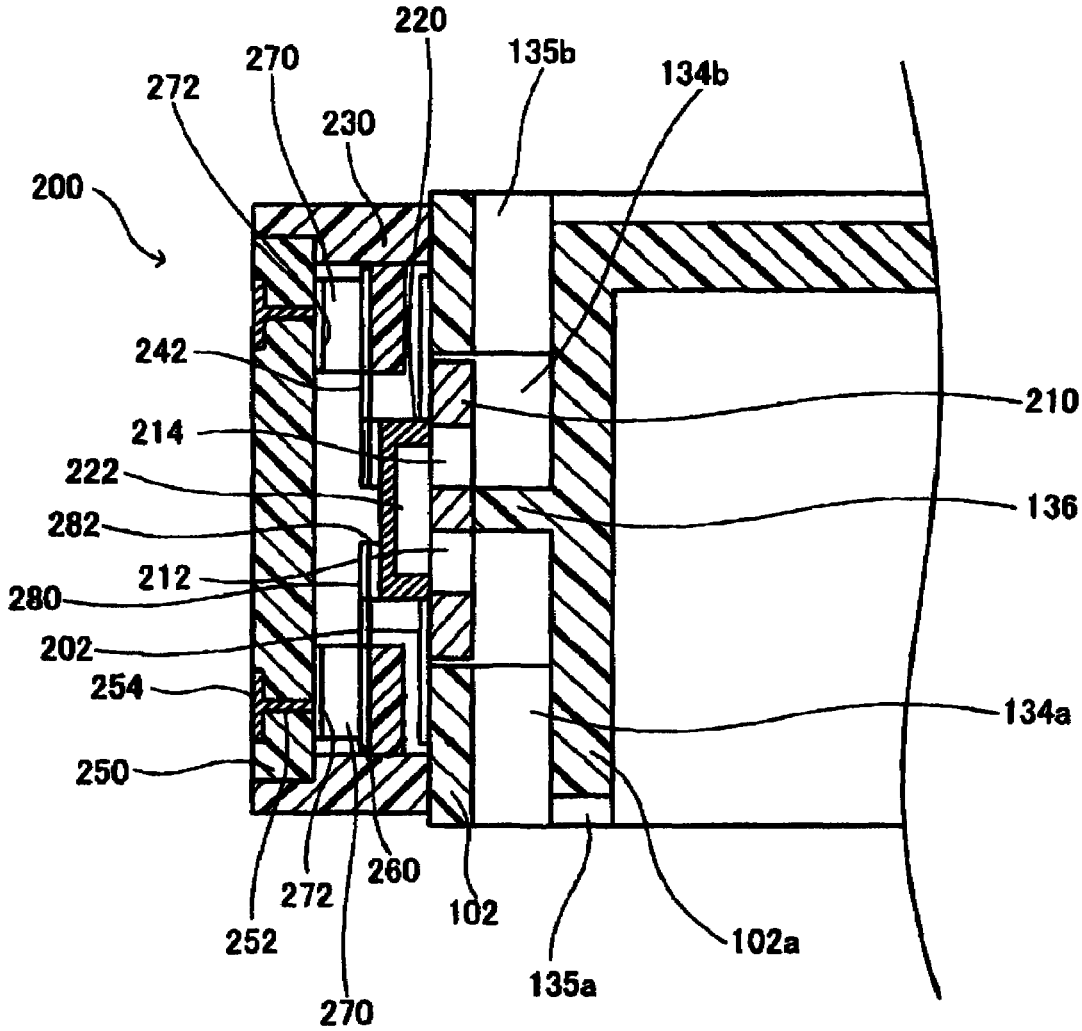
FIG. 16 is a sectional view of an assembled ink detector.
Figure 23:
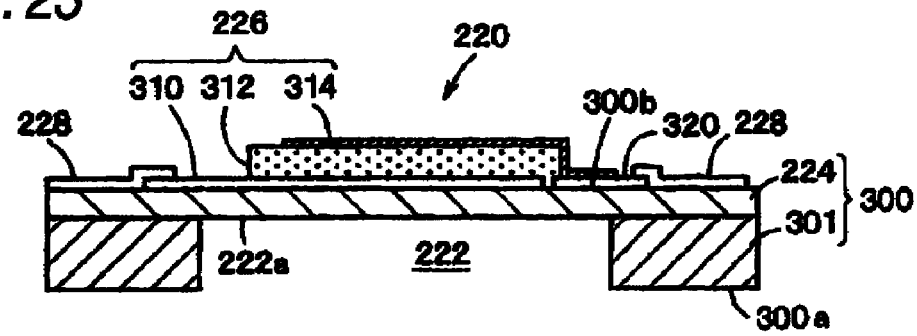
FIG. 23 is a sectional view of the sensor chip.

FIG. 15 is a perspective view of the sensor base 210 mounted with the sensor chip 220 as viewed from the upside. FIG. 16 is a sectional view schematically illustrating a state where the ink detector 200 shown in FIGS. 2 and 3 is assembled. FIG. 23 is a sectional view of the sensor chip.

In FIGS. 16 and 23, the sensor chip 220 has a sensor cavity 222 receiving the ink (liquid) as a detection target and the lower surface of the sensor cavity 222 is opened to receive the ink. The upper surface of the sensor cavity 222 is closed by a vibrating plate 224 as shown in FIGS. 15 and 23. A piezoelectric element 226 is disposed on the upper surface of the vibrating plate 224.

Specifically, as shown in FIG. 23, the sensor chip 220 includes a vibration cavity forming base 300 that is constructed by stacking the vibrating plate 224 on a cavity plate 301 and that has a first surface 300*a* and a second surface 300*b* opposed to each other. The sensor chip 220 further includes the piezoelectric element 226 stacked on the second surface 300*b* of the vibration cavity forming base 300.

In the vibration cavity forming base 300, the cavity 222 having a cylindrical space shape for receiving the medium (ink) as the detection target is opened in the first surface 300*a* and the bottom surface 222*a* of the cavity 222 can be made to vibrate by the vibrating plate 224. In other words, the portion actually vibrating in the vibrating plate 224 is defined in outline by the cavity 222. Electrode terminals 228 and 228 are formed on both sides of the second surface 300*b* of the vibration cavity forming base 300.

A lower electrode 310 is formed on the second surface 300*b* of the vibration cavity forming base 300 and the lower electrode 310 is connected to one electrode terminal 228.

A piezoelectric layer 312 is stacked on the lower electrode 310 and an upper electrode 314 is stacked on the piezoelectric layer 312. The upper electrode 314 is connected to an assistant electrode 320 insulated from the lower electrode 310. The assistant electrode 320 is connected to the other electrode terminal 228.

The piezoelectric element 226 performs the function of determining the ink end on the basis of the difference in electrical characteristics (such as frequency) due to the existence of the ink in the sensor cavity 222. The piezoelectric layer may be formed of piezoelectric zirconate titanate (PZT), piezoelectric lead zirconate titanate (PLZT), or a lead-free piezoelectric film not containing lead.

The sensor chip 220 is fixed monolithically to the sensor base 210 by an adhesive layer 216 by placing the bottom of the chip body on the top center portion of the sensor base 210, and the space between the sensor base 210 and the sensor chip 220 are sealed by the adhesive layer 216.

Detection of Amount of Remaining Ink

As shown in FIG. 16, the ink introduced from the supply hole 135*a* of the ink delivery channel 134 stays in the upstream buffer chamber 134*a* which is one chamber partitioned by the partition wall 136.

The upstream buffer chamber 134*a* communicates with the sensor cavity 222 of the sensor chip 220 through the first hole 212 of the sensor base 210. Accordingly, the ink in the upstream buffer chamber 134*a* is guided to the sensor cavity 222 through the first hole 212 with the supply of the ink. Here, the vibration of the vibrating plate 224 made to vibrate by the piezoelectric element 226 is transmitted to the ink and the existence of the ink is detected on the basis of the frequency of the residual vibration waveform. In the endpoint where air enters the sensor cavity 222 in addition to the ink, the attenuation of the residual vibration waveform is great and the residual vibration waveform becomes a frequency higher than that of the case where the ink is filled full. By detecting the state, the ink end can be detected.

Specifically, when a voltage is applied to the piezoelectric element 226, the vibrating plate 224 is deformed with the deformation of the piezoelectric element 226. When the application of the voltage is stopped after the piezoelectric element 226 is forcibly deformed, the bending vibration remains in the vibrating plate 224 for a moment. The residual vibration is free vibration of the vibrating plate 224 and the medium in the sensor cavity 222. Accordingly, by setting the voltage applied to the piezoelectric element 226 to a pulse waveform or a rectangular waveform, the resonance state of the vibrating plate 224 and the medium after the application of the voltage can be easily obtained.

The residual vibration is the vibration of the vibrating plate 224 and accompanies the deformation of the piezoelectric element 226. Accordingly, the piezoelectric element 226 generates a back electromotive force with the residual vibration.

As shown in FIG. 16, the circuit board 250 includes an electrode 254 connected to a through-hole 252 penetrating the front and rear surfaces thereof. A signal from the sensor chip 220 is transmitted to the circuit board 250 through the relay terminal 260.

Figure 17:
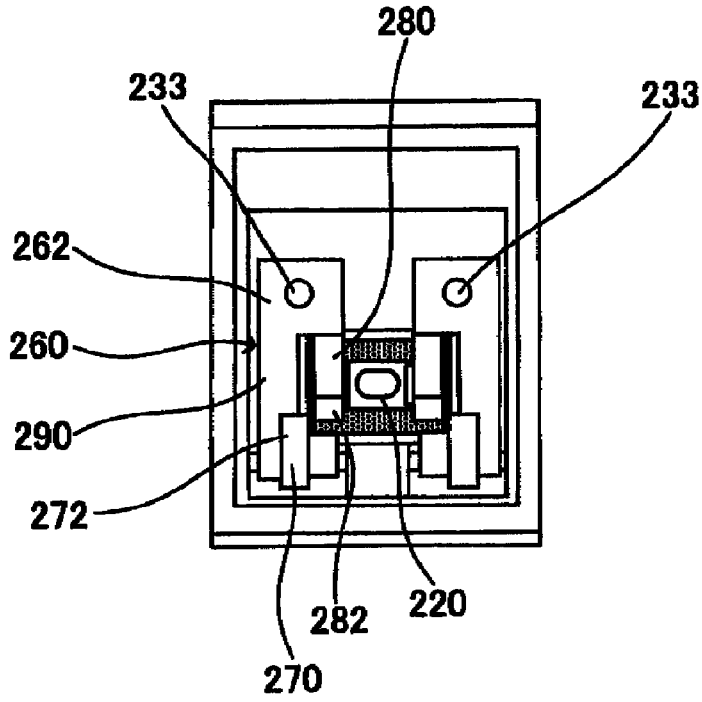
FIG. 17 is a plan view illustrating a state where a circuit board is removed from the ink detector shown in FIG. 16.
Figure 18:
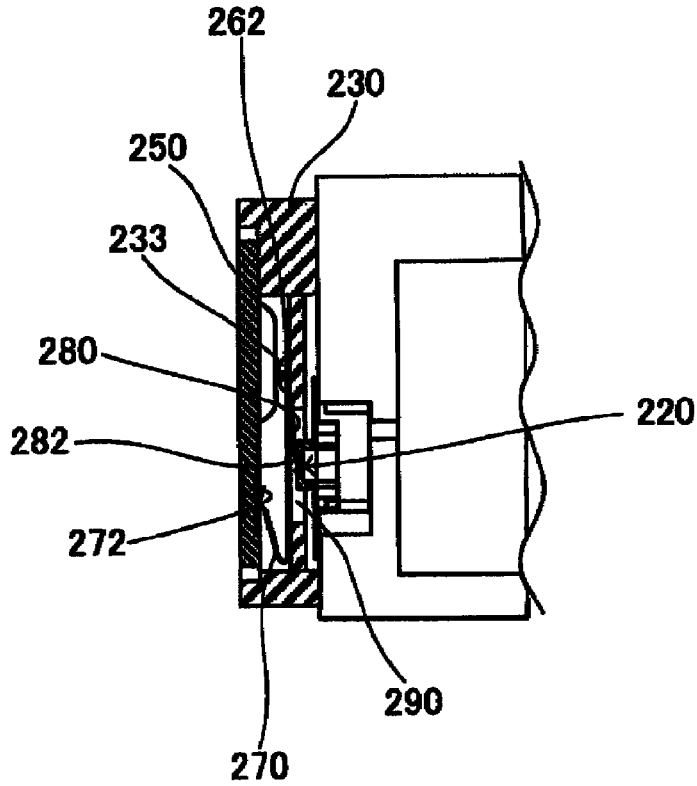
FIG. 18 is a sectional view illustrating a section of the ink detector in a direction perpendicular to a direction of the cross-section of FIG. 16.

Here, a state where the relay terminal 260 shown in FIGS. 4 to 6 is attached to the main case 102 through the pressing cover 232 shown in FIGS. 7A to 9 and it is viewed at a direction different from that of FIG. 16 is shown in FIGS. 17 and 18. FIG. 17 is a plan view in which the circuit board 250 is omitted and FIG. 18 is a sectional view in the direction perpendicular to FIG. 16.

In FIGS. 16 to 18, the signal from the sensor chip 220 passes through the second contact 282, the second free end portion 280, the base end portion 262, the intermediate portion 290, the first free end portion 270, and the second contact 272 of the relay terminal 260 and is input to an analysis circuit (not shown) mounted on the printer body through the through-hole 252 and the electrode 254. The processing result of the analysis circuit is transmitted to a semiconductor memory (not shown) mounted on the circuit board 250. That is, That is, the back electromotive force of the piezoelectric element 226 is transmitted to the analysis circuit through the relay terminal 260 and the result is stored in the semiconductor memory.

Since the resonance frequency can be specified by the use of the back electromotive force detected as described above, the existence of the ink in the ink cartridge 100 can be detected on the basis of the resonance frequency. The semiconductor memory stores identification information such as the kind of the ink cartridge 100, information on the color of the ink contained in the ink cartridge 100, and information on the amount of remaining ink. At this time, as described above, since the first and second contacts 272 and 282 of the relay terminal 260 can be adjusted to the proper contact pressures, the signal can be reliably transmitted.

The ink staying in the sensor cavity 222 is guided to the downstream buffer chamber 134*b* through the second hole 214 of the sensor base 210 with the additional supply of the ink. The ink is supplied along the ink delivery channel 134 through the ink outlet 135*b*, and is finally discharged from the ink cartridge 100 through the ink supply section 110 (see FIG. 2).

Method and Structure for Supporting Sensor Base

When it is intended to fit the sensor base 210, the sensor chip 220, and the film 202 to the opening 130, the following two processes are required. That is, a first process of disposing the metal sensor base 210 mounted with the sensor chip 220 in the opening 130 of the main case 102 having the flow channel 134 formed therein to face the flow channel 134 and a second process of welding the film 202 to the rib 132 around the opening 130 to allow the sensor base 210 to be supported by the main case 102 with the film 202 interposed therebetween are necessary. With the first process and the second process, the sensor cavity 222 formed in the sensor chip 220 communicates with the upstream buffer chamber 134*a* through the first hole 212 formed in the sensor base 210 and communicates with the downstream buffer chamber 134*b* through the second hole 214 formed in the sensor base 210, thereby forming the detection path of the liquid as described above.

In this embodiment, in the first process before welding the film 202, the sensor base 210 is supported by only the partition wall 136 (supporting function using the partition wall). Before the film 202 is welded to the welding rib 132 around the opening 130, the sensor base 210 should be temporarily positioned at a predetermined position of the opening 130. After the sensor base 210 is supported by the film 202 in the second process, the sensor base 210 can come in contact with only the partition wall 136 in the depth direction of the opening 130 (upstream and downstream partitioning function using the partition wall). Since the sensor base 210 is supported by the film 202, the sensor base 210 does not always be in contact with the partition wall 136 but the upstream and downstream partitioning function of the partition wall 136 is always necessary.

Here, as shown in FIG. 16, in this embodiment, a channel wall 102*a* disposed opposite the sensor base 210 is provided to define the ink delivery channel 134. The partition wall 136 is formed monolithically with the channel wall 102*a*. The partition wall 136 is an essential structure for partitioning the ink delivery channel 134 into the upstream buffer chamber 134*a* and the downstream buffer chamber 134*b*. This is because it is not guaranteed that the ink or the bubbles as the medium in the ink delivery channel 134 pass through the sensor cavity 222 when the partition wall 136 is not disposed. When the ink or the bubbles in the ink delivery channel 134 do not pass through the sensor cavity 222, the sensor chip 220 false detects the end point of the ink.

In order to partition the ink delivery channel 134 into the upstream buffer chamber 134*a* and the downstream buffer chamber 134*b*, the partition wall 136 should come in contact with the sensor base 210 or the gap between the sensor base 210 and the partition wall 136 is small so as not to allow the bubbles to pass through the gap. In other words, the flow resistance of the gap should be greater than the flow resistance of the first hole 212, thereby not permitting the passage of the bubbles. This is the inherent function of the partition wall 136.

On the other hand, the partition wall 136 is contacted and supported by the sensor base 210 at the time of fitting the sensor base 210 (first process), thereby preventing the sensor base 210 from falling into the opening 130. That is, in the first process, the partition wall 136 has the function of temporarily supporting the sensor base 210.

After the film 202 is welded to the welding rib 132 around the opening 130 and the sensor base 210 and the sensor chip 220 are attached to the opening 130, the sensor base 210 comes in contact with only the partition wall 136, except for the sensor chip 220 and the film 202. That is, the sensor base 210 can come in contact with only the partition wall 136 in the depth direction of the opening 130.

Accordingly, it is possible to detect the residual vibration waveform by the use of the piezoelectric element 226. In this embodiment, the main case 102 of the ink detector 200 is a part of the main case of the ink cartridge 100 and has a great capacity. In general, the main case 102 is formed of a flexible resin material such as polypropylene and thus the absorption of vibration thereof increases with the increase in capacity.

Here, when the piezoelectric element 226 vibrates, the sensor base 210 mounted with the sensor chip 220 also vibrates in addition to the vibrating plate 224. When the contact area between the sensor base 210 and the main case 102 is great, the vibration of the sensor base 102 is absorbed by the main case 102. In this case, the amplitude of the residual vibration waveform is not enough to detect the residual vibration waveform by the use of the piezoelectric element 226.

In this embodiment, since the sensor base 210 is supported by only the film 202 and the partition wall 136, the vibration wave absorbed by the main case 102 is minimized and thus the amplitude enough to detect the residual vibration by the use of the piezoelectric element 226 is guaranteed.

Figure 19:
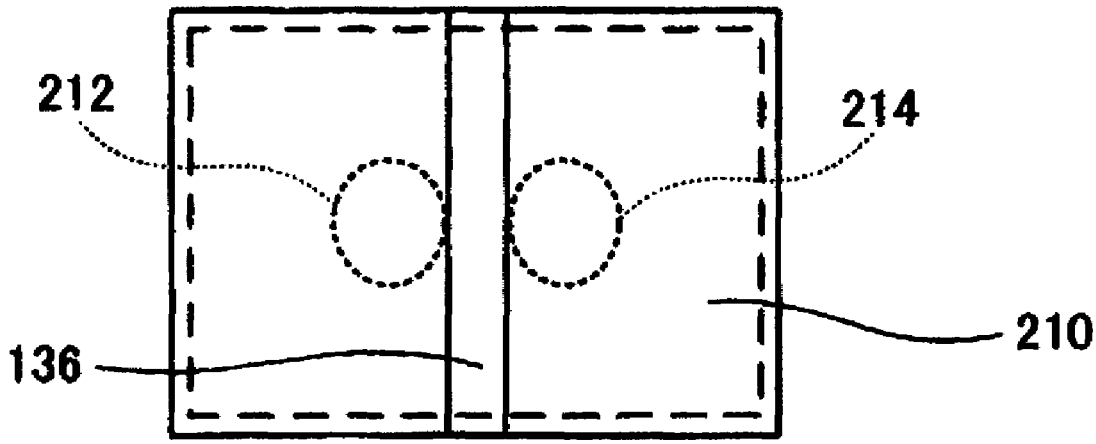
FIG. 19 is a diagram schematically illustrating a positional relation between first and second holes of the sensor base and a partition wall.

FIG. 19 is a sectional view of the partition wall 136 as viewed from the downside. The partition wall 136 is located between the first and second holes 212 and 214 of the sensor base 210. The thickness of the end of the partition wall 136 is the maximum when the partition wall 136 comes in contact with the first and second holes 212 and 214 and should not be set to clog the first and second holes 212 and 214. The clogging enhances the flow resistance of the first and second holes designed with predetermined flow resistance.

MODIFIED EXAMPLE

Although this embodiment has been described in detail, it should be understood by those skilled in the art that the embodiment can be modified in various forms without departing from the idea and advantages of the invention. Therefore, the following modified examples should be included in the scope of the invention. For example, in the specification or drawings, a term described at least once along with another term having broader meaning or equivalent meaning can be replaced with the another term in any place of the specification or drawings.

Figure 20A:
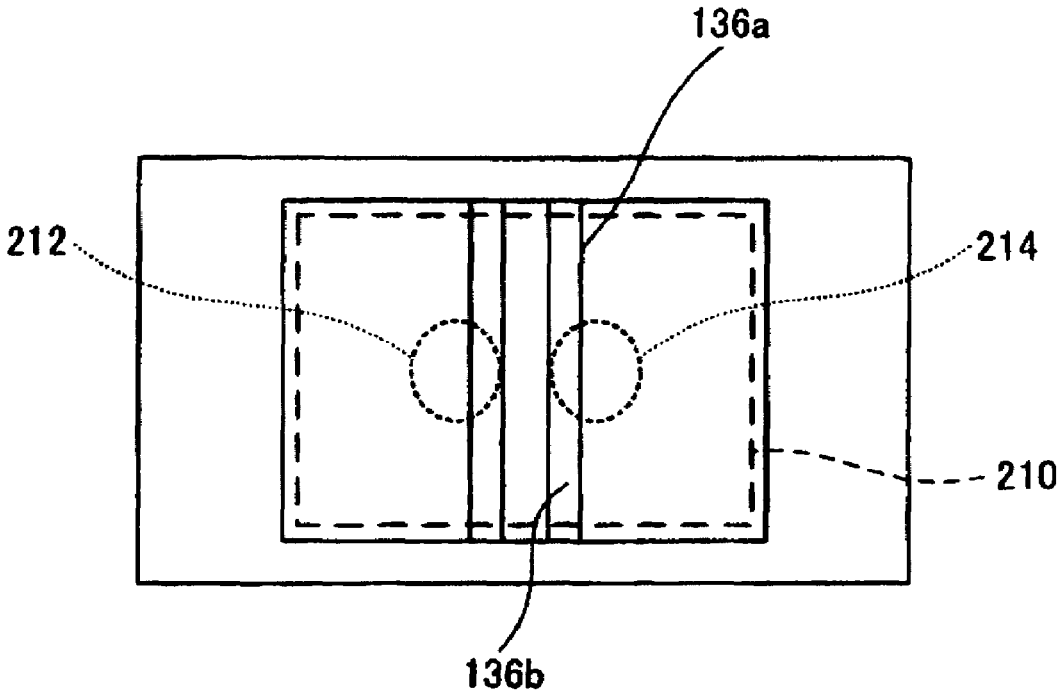
FIGS. 20A and 20B are diagrams illustrating modified examples of the partition wall.
Figure 20B:
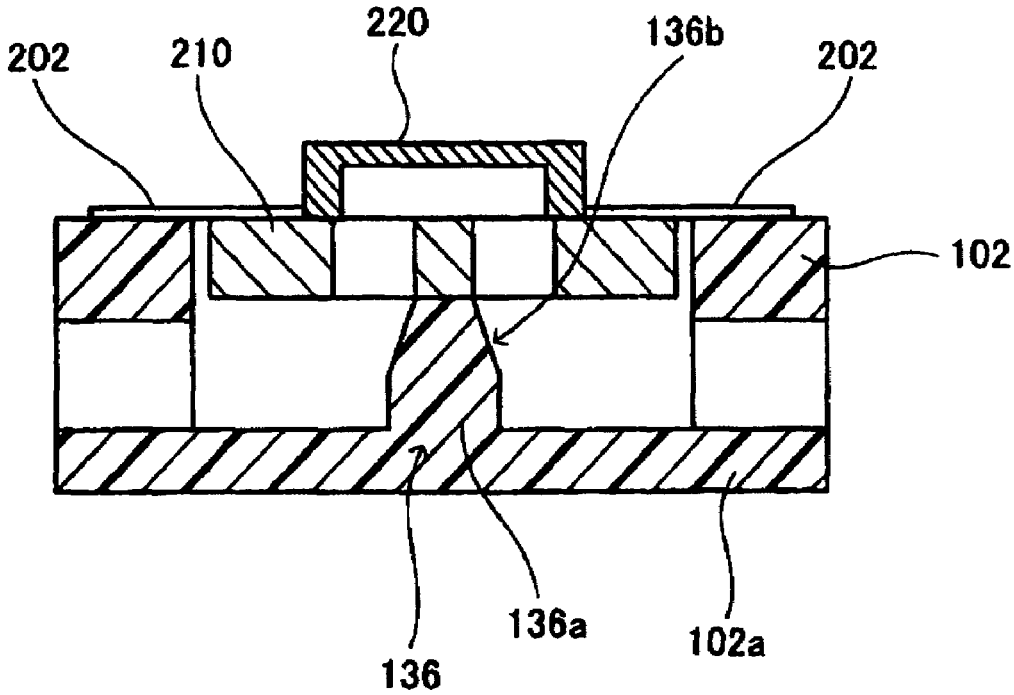

As shown in FIGS. 20A and 20B, the partition wall 136 may have a shape in which the thickness of the free end 136*b* is smaller than that of the base end portion 136*a* close to the channel wall 102*a*. That is, even when the base end portion 136*a* is broader than the inter-edge distance of the first and second holes 212 and 214, it does not cause any problem so long as the thickness of the free end 136*b* is equal to or less than the inter-edge distance as shown in FIG. 16. This is because it does not enhance the flow resistance of the first and second holes 212 and 214. By broadening the base end portion 136*a*, the shaping property for the insertion molding can be improved. As the method of thinning the free end 136*b*, the free end may not be tapered with a slope as shown in FIG. 20B, but may be curved.

Figure 21A:
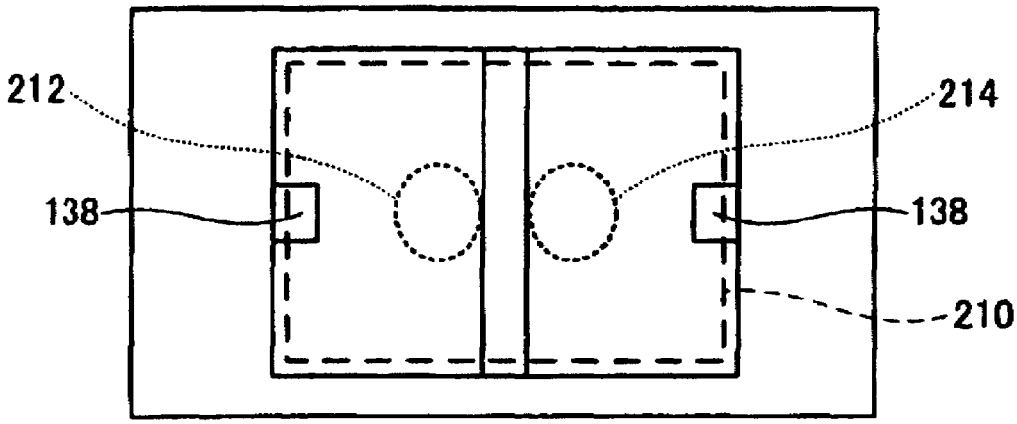
FIGS. 21A and 21B are diagrams illustrating modified examples in which an assistant support portion is provided.
Figure 21B:
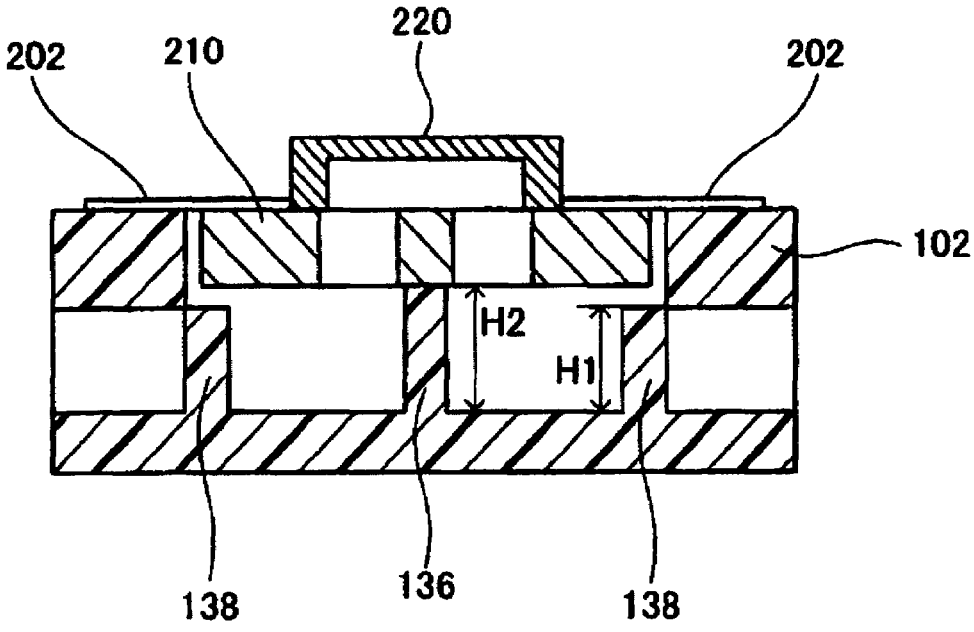

In order to enhance the stability of the attachment of the sensor base 210, the configuration shown in FIGS. 21A and 21B may be employed. That is, an assistant support rib 138 may be provided in addition to the partition wall 136. In FIGS. 21A and 21B, two assistant support ribs 138 contactable with both ends in the longitudinal direction of the sensor base 210 are disposed. However, the height H1 from the channel wall 102*a* to the end of two assistant support ribs 138 is smaller than the height H2 to the end of the partition wall 136.

In the embodiment shown in FIG. 16, since the sensor base 210 is supported by only the partition wall 136 at the time of attachment, the center of the sensor base 210 is supported like a seesaw, which provides bad stability. In the embodiment shown in FIGS. 21A and 21B, even when the sensor base 210 is inclined, the lowered end thereof comes in contact with the assistant support rib 138 and is supported at two points including the partition wall 136, which provides good stability.

However, regarding the assistant support rib 138, since the sensor base 210 is substantially parallel to the channel wall 102*a* after the sensor base 210 is assembled as shown in FIG. 21B, the sensor base 210 does not come in contact with the assistant supporting rib 138. Accordingly, similarly to the embodiment shown in FIG. 16, the amplitude of the residual vibration waveform can be guaranteed greatly.

After the sensor base 210 is assembled, the assistant support rib 138 can prevent the sensor base 210 from being excessively inclined even in the abnormal state where falling impact force acts. Accordingly, it is possible to prevent the sensor base 210 supported by the film 202 from being excessively inclined to tear down the film 202.

Figure 22:
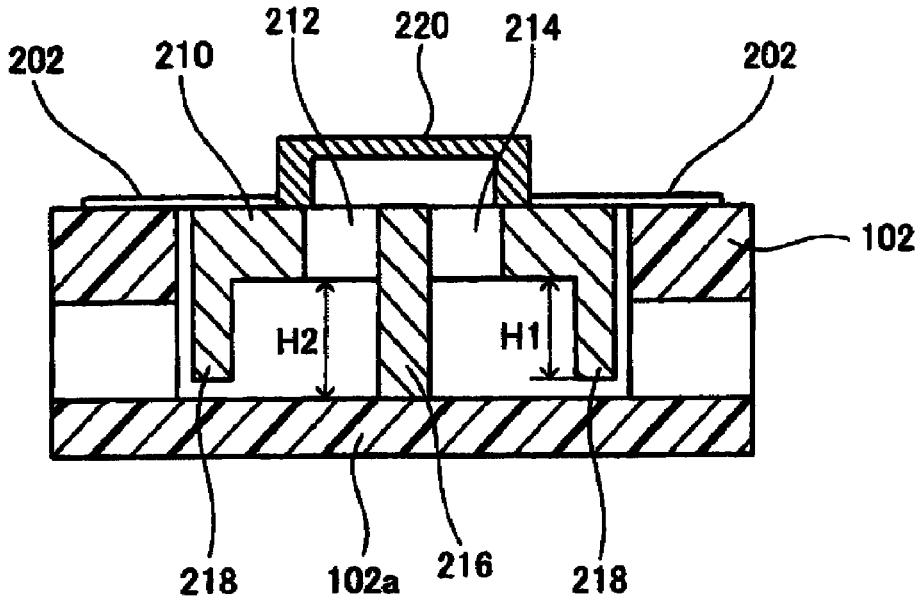
FIG. 22 is a diagram illustrating a modified example where the partition wall and the assistant support portion are provided in the sensor base.

The position of the partition wall 136 is not limited to the channel wall 102*a*. For example, as shown in FIG. 22, a partition wall 216 vertically extending downward from between the first and second holes 212 and 214 of the sensor base 210 may be provided. The partition wall 216 comes in contact with the channel wall 102*a* or is opposed to the channel wall with a slight gap having the flow resistance greater than the flow resistance of the first hole 212. In FIG. 22, an assistant support rib 218 vertically extending downward from both ends in the longitudinal direction of the sensor base 210 is provided. The height H1 from the bottom surface of the sensor base 210 to the end of two assistant support ribs 218 is smaller than the height H2 to the end of the partition wall 216. In this case, the same advantages as the embodiment shown in FIGS. 21A and 21B can be obtained. A partition wall may be disposed in one of the channel wall 102*a* and the sensor base 210 and an assistant support rib may be disposed in the other. In this way, when the partition wall 216 and/or the assistant support ribs 218 are disposed in the sensor base 210, the sensor base 210 is subjected to, for example, a cutting process.

The application of the liquid container according to the embodiment of the invention is not limited to the ink cartridge of the inkjet printing apparatus. The invention may be applied to a variety of liquid consuming apparatuses having a liquid ejecting head for ejecting minute ink droplets.

Specific examples of the liquid consuming apparatuses may include an apparatus having a coloring material ejecting head used for manufacturing a color filter of a liquid crystal display and the like, an apparatus having an electrode material (conductive paste) ejecting head used for forming electrodes of an organic EL display, a field emission display (FED), and the like, an apparatus having a biological organic material ejecting head used for manufacturing a bio chip, an apparatus having a sample ejecting head as a precise pipette, and a printing apparatus or a micro dispenser.

The liquid detector according to the embodiment of the invention is not limited to the on-carriage type ink cartridge, but may be a sub tank not mounted on the carriage or an off-carriage type ink cartridge.

Figure 24:
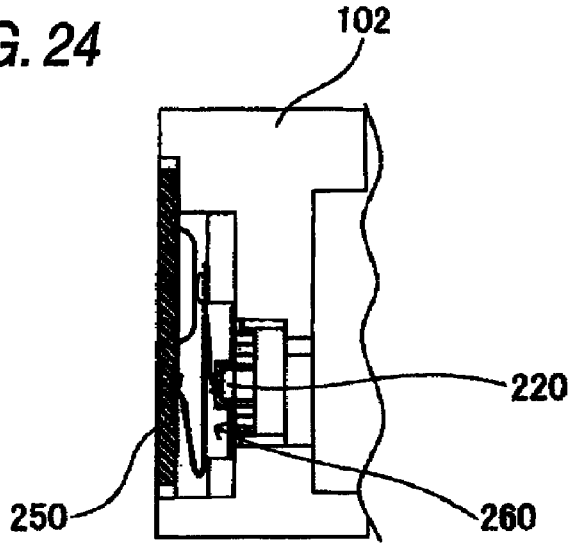
FIG. 24 is a sectional view illustrating a modified example where a circuit board is directly supported by a main case without using the pressing cover.

The liquid detector or the liquid container according to the embodiment of the invention uses the case body of the liquid detector as a part of the case body of the liquid container as shown in FIG. 24, thereby omitting the pressing cover 232. That is, the circuit boar 250 can be supported directly by the main case 102.

In the above-mentioned embodiments, the case body of the liquid detector is also used as the case body of the liquid container and the sealing rubber or spring described in JP-A-2006-281550 is excluded, but the invention is not limited to the configuration. The liquid detector can be configured as a unit independent of the case body of the liquid container. In this case, the sealing rubber or spring may not be excluded, but it can contribute to suppressing the absorption of vibration in the unit case in minimum and guaranteeing the amplitude of the detected waveform greatly, even when the unit case increases in size.

In the above-mentioned embodiment, the liquid ejecting apparatus may be embodied in a so-called full-line type (line head type) printer in which the whole shape of the print head 19 corresponds to the length in the width direction (lateral direction) of a printing sheet (not shown) in the direction intersecting the transport direction (longitudinal direction) of the printing sheet (not shown).

In the above-mentioned embodiment, the liquid ejecting apparatus is embodied in the inkjet printer 11, but not limited to the inkjet printer. The invention may be embodied in a liquid ejecting apparatus spraying or ejecting a liquid (including a liquid material in which functional material particles are dispersed or mixed in a liquid and a fluid material such as gel) other than the ink. Examples thereof include a liquid material ejecting apparatus ejecting a liquid material including in a dispersed or dissolved type a material such as electrode material or coloring material (pixel material) used for manufacturing a liquid crystal display, an electroluminescence (EL) display, or a surface emission display, a liquid ejecting apparatus ejecting a biological organic material used for manufacturing a bio chip, and a liquid ejecting apparatus ejecting a liquid as a sample in a precise pipette. Examples thereof can also include a liquid ejecting apparatus ejecting lubricant to a precise machine such as a watch or camera with a pin point, a liquid ejecting apparatus ejecting transparent resin liquid such as UV-curable resin to a substrate to form minute semi-spherical lenses (optical lenses) used in optical communication devices, a liquid ejecting apparatus ejecting etchant such as acid or alkali to etch a substrate and the like, and a fluid material ejecting apparatus ejecting a fluid material such as gel (for example, physical gel). The invention can be applied to at least one kind of the above-mentioned liquid ejecting apparatuses. In this specification, the "liquid" does not include a liquid containing only gas, and examples of the liquid include a liquid material and a fluid material, in addition to inorganic solvent, organic solvent, solution, liquid-phase resin, and liquid-phase metal (metal solution).

What is claimed is:

1. A liquid detector comprising:

a case in which a flow channel is exposed from an opening;

a sensor base, disposed in the opening of the case to face the flow channel;

a sensor chip, mounted on a surface opposite to a surface of the sensor base which faces the flow channel and including a piezoelectric element;

a film, adapted to hold the sensor base in the opening and sealing the opening;

a circuit board, disposed in such a manner as to face the sensor chip;

a relay terminal, electrically connecting the sensor chip and the circuit board; and a support member, adapted to support the circuit board and the relay terminal and fixed to the case, wherein the relay terminal includes: a base end portion, fixed to the support member; and first and second free end portions, separately extending into two branches from the base end portion, and a first contact connected to the circuit board is formed in the first free end portion, and a second contact connected to the sensor chip is formed in the second free end portion.

2. The liquid detector according to claim 1, wherein the first contact and the second contact are bent in directions opposite to each other with respect to a two-dimensional plane of the support member which is in contact with the base end portion.

3. The liquid detector according to claim 2, wherein the relay terminal includes an intermediate portion between the base end portion and the first free end portion, and the first free end portion has a folded portion which is folded at a boundary between the intermediate portion and the first free end portion and in which the first contact is formed.

4. The liquid detector according to claim 3, wherein the support member includes positioning portions being in contact with both ends in a width direction of the intermediate portion, and the positioning portions are formed by protrusions protruding from the two-dimensional plane.

5. The liquid detector according to claim 4, wherein the intermediate portion includes: a small-width portion, extending in parallel to the second free end portion; and a large-width portion, disposed between the small-width portion and the first free end portion to expand and protrude toward the second free end portion, and the positioning portions are in contact with both ends in a width direction of the large-width portion.

6. The liquid detector according to claim 1, wherein a length from the base end portion to the first free end portion is greater than a length from the base end portion to the second free end portion, and the support member includes positioning portions being in contact with both ends in a width direction of the first free end portion.

7. The liquid detector according to claim 1, further comprising:

a partition wall, partitioning the flow channel in the case into upstream and downstream, wherein the sensor chip includes a sensor cavity adapted to receive liquid as a detection target, the sensor base includes a first hole guiding the liquid from the upstream in the flow channel to the sensor cavity and a second hole guiding the liquid from the sensor cavity to the downstream in the flow channel, and the sensor base is contactable with the case through only the partition wall which is located between the first hole and the second hole of the sensor base in a depth direction of the opening.

8. The liquid detector according to claim 1, wherein the case is a part of a container containing liquid.

9. A liquid container comprising:

the liquid detector according to claim 1.

10. A liquid detector comprising:

a piezoelectric unit including:

a vibration plate, a first surface of which is in contact with liquid;

a piezoelectric element, in which a first electrode, a piezoelectric layer and a second electrode are laminated, the piezoelectric layer arranged between the first and second electrodes, and which is disposed on a second surface of the vibration plate;

a first terminal, provided at a side of the second surface, and electrically coupled to the first electrode; and a second terminal, provided at a side of the second surface, and electrically coupled to the second electrode;

a support portion, adapted to support a circuit board arranged in such a manner as to face the piezoelectric unit;

a first relay terminal, electrically connecting the first terminal with the circuit board; and a second relay terminal, electrically connecting the second terminal with the circuit board, wherein each of the first relay terminal and the second relay terminal include:

a contact portion, being in contact with and supported by the support portion;

a first projecting portion, projecting from the contact portion to a side of the circuit board, a free end portion of which is formed with a first contact being in contact with the circuit board; and a second projecting portion, projecting from the contact portion to a side of the piezoelectric unit, a free end portion of which is formed with a second contact being in contact with the first terminal or the second terminal, wherein the first projecting portion projects from a first end portion of the contact portion toward a second end portion of the contact portion, and the second projecting portion projects from the second end portion toward the first end portion.

11. The liquid detector according to claim 10, wherein the contact portion includes: a fixing portion, fixed to the support portion; and a positioning portion, positioned to the support portion.

12. The liquid detector according to claim 10, wherein the first projecting portion and the second projecting portion are substantially parallel to each other.

* * * * *